United States Patent [19]

Fischer et al.

[11] Patent Number: 4,605,841

[45] Date of Patent: Aug. 12, 1986

[54] THERMOSTAT FOR ELECTRIC HOTPLATE

[75] Inventors: Karl Fischer, Oberderingen; Felix Schreder, Oberderdingen; Robert Kicherer, Knittlingen, all of Fed. Rep. of Germany

[73] Assignee: E.G.O. Elektro-Gerate Blanc und Fischer, Fed. Rep. of Germany

[21] Appl. No.: 511,104

[22] Filed: Jul. 6, 1983

[30] Foreign Application Priority Data

| | | | |
|---|---|---|---|
| Jul. 7, 1982 | [DE] | Fed. Rep. of Germany | 8219461[U] |
| Jul. 14, 1982 | [DE] | Fed. Rep. of Germany | 3226264 |
| Sep. 28, 1982 | [DE] | Fed. Rep. of Germany | 8227145[U] |
| Jan. 20, 1983 | [DE] | Fed. Rep. of Germany | 3301689 |

[51] Int. Cl.[4] ..... H05B 3/68

[52] U.S. Cl. ..... 219/449; 219/452

[58] Field of Search ..... 219/448, 449, 452, 462, 219/464, 494

[56] References Cited

U.S. PATENT DOCUMENTS

| | | | |
|---|---|---|---|
| 2,684,430 | 7/1954 | Billing | 219/449 |
| 3,684,862 | 8/1972 | Fischer et al. | 219/450 |
| 4,122,330 | 10/1978 | Fischer et al. | 219/449 |
| 4,135,081 | 1/1979 | Fischer | 219/449 |
| 4,153,833 | 5/1979 | Fischer et al. | 219/449 |
| 4,348,581 | 9/1982 | Fischer et al. | 219/460 |

FOREIGN PATENT DOCUMENTS

| | | | |
|---|---|---|---|
| 915010 | 7/1954 | Fed. Rep. of Germany | 219/449 |
| 1026015 | 3/1958 | Fed. Rep. of Germany . | |
| 1104087 | 4/1961 | Fed. Rep. of Germany | 219/449 |
| 1123059 | 2/1962 | Fed. Rep. of Germany . | |
| 1127007 | 4/1962 | Fed. Rep. of Germany . | |
| 1615258 | 7/1970 | Fed. Rep. of Germany . | |
| 7612737 | 10/1976 | Fed. Rep. of Germany . | |
| 2943922 | 5/1981 | Fed. Rep. of Germany . | |
| 3027998 | 2/1982 | Fed. Rep. of Germany . | |
| 3124776 | 9/1982 | Fed. Rep. of Germany | 219/449 |
| 3226264 | 1/1984 | Fed. Rep. of Germany | 219/449 |
| 2511125 | 2/1983 | France | 219/449 |
| 376594 | 5/1964 | Switzerland . | |
| 1212941 | 11/1970 | United Kingdom . | |

*Primary Examiner*—Clarence L. Albritton
*Assistant Examiner*—Teresa Walberg
*Attorney, Agent, or Firm*—Steele, Gould & Fried

[57] ABSTRACT

A thermostat for an electric hotplate has a casing formed in one piece from an insulating material with a bottom and four side walls defining one open-sided recess therebetween, a snap-action switch, a support, and a bimetallic strip mounted on the support and acting on the switch, the casing having slots formed therein for fixing the switch, support, and strip in the recess. the recess remains open at the one side when the casing is mounted on the hotplate. Interfitting locking structure on the support and formed interiorly on at least one of the side walls can be brought into mutual engagement by movement of the support substantially parallel to the bottom of the casing, whereby the bimetallic strip is safely and securely held in the recess notwithstanding the absence of a cover for the recess. The thermostat is mounted in an unheated central zone of the electric hotplate, and the thermal coupling between the thermostat and the hotplate can be controlled by orienting the open-side of the recess toward or parallel to the underside of the electric hotplate.

25 Claims, 16 Drawing Figures

THERMOSTAT FOR ELECTRIC HOTPLATE

BACKGROUND OF THE INVENTION

1. Field of the Invention

The invention relates to electric hotplates with a thermostat.

2. Prior Art

Such a thermostat is known from German Pat. No. 1,123,059. Millions of such thermostats have been incorporated into hotplates; they function extremely reliably and are particularly suitable for functioning as thermostats with a high switching hysteresis relatively weakly coupled to the temperature of the heating system. The thermostat comprises a crescent-shaped insulating casing, whose recess contains a snap-action switch and a bimetallic strip parallel thereto, while being fixed by passing through slots of openings. The casing is closed by a cover and the thermostat is arranged in the unheated central area of the electric hotplate and partially surrounds the cast central pin. The cover points downwards and the snap-action switch and bimetallic strip are laterally secured.

SUMMARY OF THE INVENTION

The object of the present invention is to provide a thermostat, which can be manufactured even less expensively and which has smaller dimensions, while its coupling characteristics to the hotplate are improved. According to the invention, this object is achieved in that the recess is open to one side in the built-in state.

As a result of the box-like casing, which is open on one side, the bimetallic strip is coupled better to the temperature to be monitored by it both by convection and by radiation. This is helped if the thermostat designed for placing in the unheated central area of the electric hotplate has its open side pointing horizontally, i.e. normally, towards the heating system. However, its coupling characteristics can also be deliberately modified by some other arrangement. It is also possible to modify the coupling characteristics by the snap-action switch and bimetallic strip being located in a horizontal plane in the built-in state, the coupling characteristics changing as a function of whether the bimetallic strip faces or is remote from the hotplate body.

The very small box-like casing not only has a very uncomplicated construction and can consequently very easily be made from ceramic material (steatite being normally used), but also has a very small weight. There is no risk of moisture being deposited on the casing through condensation and which could lead to leakage currents.

Preferably, the end and side walls of the casing surrounding the recess opening project by 1 to 3 mm over the snap-action switch and bimetallic strip. As a result of this, and the other features already described, it is possible to construct the thermostat without a cover.

According to another feature of the invention, the support carrying the snap-action switch and the bimetallic strip can be secured by an automatic locking system acting with a limited longitudinal movement.

According to one embodiment, in which the thermostat casing is supported on the cover plate and the thermostat is pressed with clearly defined contacts against one surface of the hotplate body in the unheated central area, it is possible to do away with the cover hitherto used for surrounding the thermostat, which contributes to the reduction in manufacturing and assembly costs.

The specific heat of the overall arrangement also decreases and there is also no need for the otherwise necessary insulating bushing for the connecting leads of the thermostat through the cover. Preferably, projections are provided on the casing side containing the recess opening and they are pressed into contact with the hotplate body surface. Preferably, three projections are shaped onto the edge surrounding the recess and these in particular have a rounded, or optionally, a conical configuration. Their function is on the one hand to ensure adequate spacing between the functional part of the thermostat arranged in the recess and the hotplate body, and on the other hand to ensure a clearly defined engagement, while still permitting a certain ventilation of the thermostat from below.

Advantageously, a perforated, cup-shaped covering part can be provided for the unheated central area. As a result of the tight, latticed structure of the cup, which is grounded as a result of the grounding of the hotplate body, the cup provides complete electrical protection despite an effective ventilation of the central area, so that a temperature sensor can be used, whose switch casing is at least open on one side. Advantageously, the temperature sensor of the thermostat is arranged in the switch casing. The overall level of temperature monitoring of the hotplate can be lowered somewhat, so that it is possible to use a simpler, robust switch, which is integrated with a temperature sensor. The temperature limiting action is still completely satisfactory, although at a first glance it would not appear appropriate to lower the temperature level to be monitored, before sensing it with a thermostat.

In addition, a hotplate is proposed, in which the thermostat casing is open on its side remote from the hotplate and the switch parts inserted in the recesses are protected against falling out by at least one fixing part, which at least partly covers the slots and can be placed in recesses of the switch casing, said fixing part directly engaging with the cover plate, or the hotplate body. As a result, it is possible to do away with the cap which normally surrounds the thermostat, which naturally leads to cost savings. Cost savings also result from the omission of the thermostat casing cover, particularly when assembling the switch from individual parts. The fixing part has a lower weight than the hitherto known cover, which leads to cost savings from the material side and to a reduction of the specific heat of the casing. Due to the fact that there is no need to use a covering cap, it is also possible to do without an insulating bushing for the lead-in wires for the thermostat. Features of the preferred further developments of the invention can be gathered from the following description, drawings and claims. Individual features can be realised either alone or in random combinations in connection with any embodiment of the invention.

BRIEF DESCRIPTION OF THE DRAWINGS

Nonlimiting embodiments of the invention are shown in the drawings, wherein.

DETAILED DESCRIPTION OF THE PREFERRED EMBODIMENTS

Figure 1:
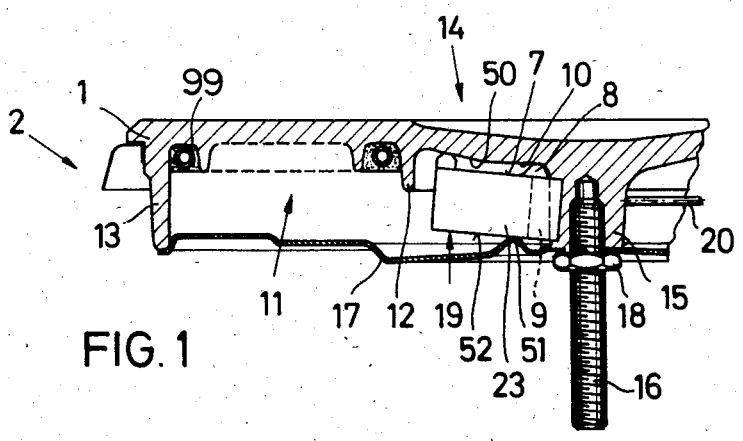
FIG. 1 is a diagrammatic partial section through a hotplate with a thermostat.

The electric hotplate 2 shown in FIG. 1 has a hotplate body 1 made from cast material, preferably cast iron, with a ring-shaped heating area 11, which is bounded to the outside and inside by downwardly projecting ring ribs 12, 13. Electric heating resistors 99 are located in the heating ring area and are embedded in insulating material in slots of the hotplate body. Within the inner ring rib 12 there is an unheated central zone 14 which is not directly heated, in whose center there is a lug 15 in the form of a downwardly projecting cast pin, into whose tap hole is screwed a clamping bolt 16.

The bottom of the electric hotplate is enclosed by a profiled cover plate 17 which, in the embodiment of FIG. 1, rests on the lower edge of the annular outer ring rib 13, covers the entire bottom surface of the hotplate and is pressed upwards by bolt 16 and a nut 18 screwed thereon.

A thermostat 19 is arranged in the unheated central zone 14. It is connected by means of lead-in wires 20 and serves to switch off the heating system or parts thereof, if the hotplate assumes a temperature above its set thermostat temperature. It is desirable for the thermostat to respond with a certain time lag, because as a result, it can be set in such a way that it permanently switches off at an elevated initial cooking or boiling power after it has responded, in order to provide adequate power for final cooking or continued boiling.

Figure 2:
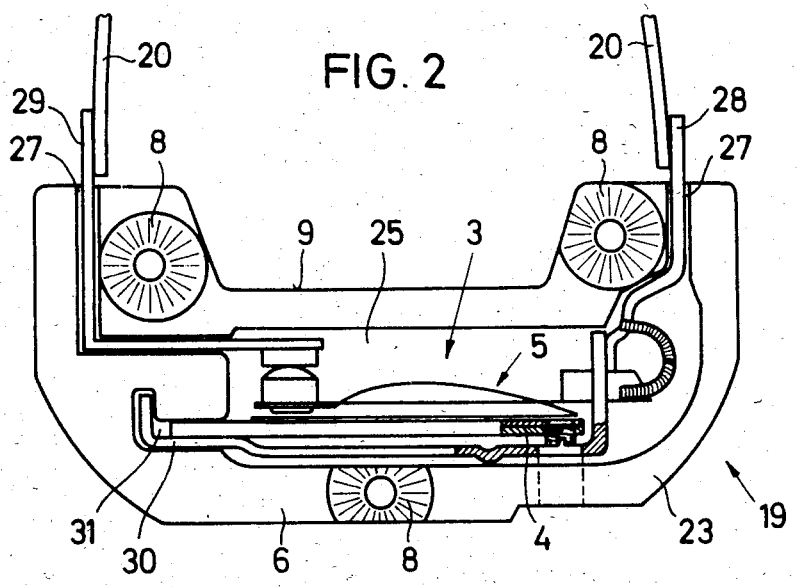
FIG. 2 is a larger-scale, plan view of a thermostat, viewed from above in FIG. 1.

Thermostat 19 is shown on a larger scale in FIG. 2. Its construction and function corresponds to German Pat. No. 1,123,059, to which reference is made. The functional parts 3 of the thermostat are arranged in a recess 25 of a casing 23, made from insulating material, such as steatite. The functional parts 3 are fixed by insertion in slots formed in casing 23. These parts include a bimetallic strip 4, which is fitted to a support 30 inserted in a slot 31, and moves the spring reed of a catch spring of a snap-action switch 5. On one end of the catch spring is provided a contact, which cooperates with a fixed opposite contact and a connecting strip 29, which like connecting strip 28 are inserted in slots 27 of the casing and consequently secured for supplying power to the catch spring. In plan view, the casing is largely crescent-shaped, or could also be described as rectangular with a recess on one longitudinal side and shoulders on the facing longitudinal side.

As can be seen in FIGS. 1 and 2, there are three projections 8 on top 7 on the casing edge 6 surrounding recess 25 and towards which recess 25 has its opening. These projections are constructed in one piece with casing 23 and have a conical configuration with a rounded tip.

It can be seen in FIG. 1 that thermostat 19 is arranged in the central area in such a way that the central lug 14 is positioned in a recess 9 which is formed on one longitudinal side of the casing. The side of the lug has a flattened portion, which meets a flattened portion 10 formed in the lower surface 50 of central area 14.

Cover plate 17 has, preferably, only one projection 51, which is constructed as an inwardly directed reinforcing corrugation of the cover plate and presses onto the flat bottom 52 of casing 23. As a result, projections 8 are firmly pressed against surface 50 of the hotplate body in the vicinity of the central area. Although the opening of recess 25 is open to the top, the recess is nevertheless covered by the surface 50 of the bottom hotplate body, located a certain distance thereabove, and is consequently protected against intrusive contact.

On tightening bolt 16 or nut 18, the thermostat is consequently pressed into contact with the hotplate body. The maintenance of this pressure is assisted by the elastic construction of the cover plate, but could also be assisted by a corresponding spring element and/or the shaping of the end cover or projection 51. For example, it would be conceivable to make the area around the projection resilient by providing slots in the cover plate.

Figure 3:
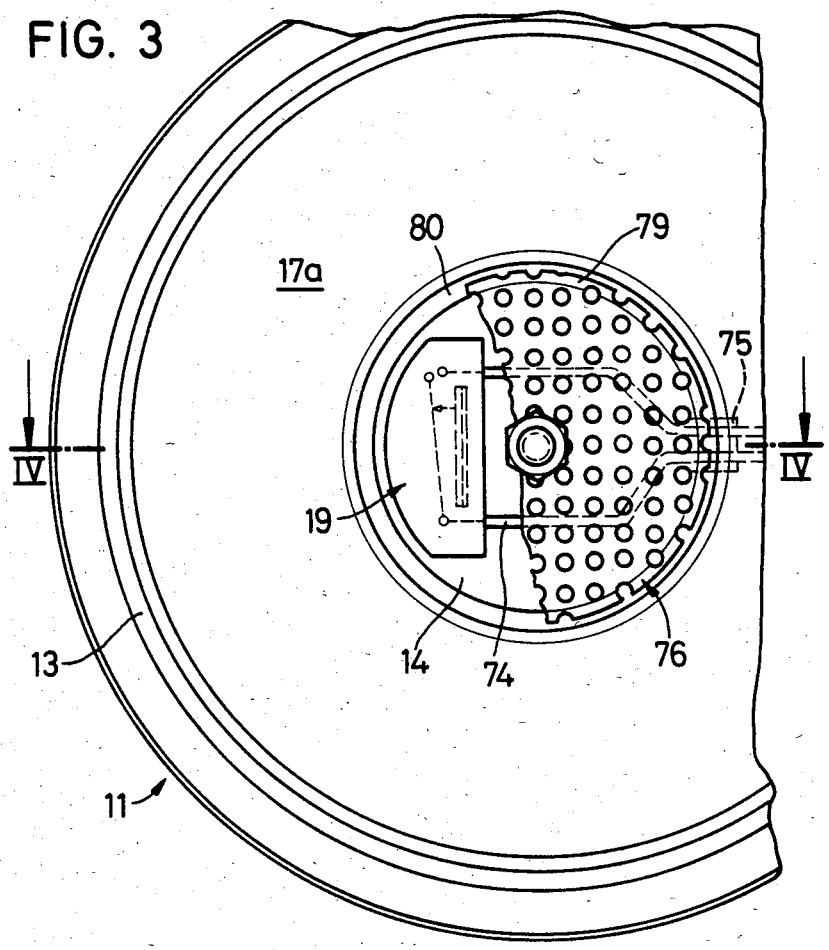
FIG. 3 is a partly broken away view from below of a hotplate with a covering part.
Figure 4:
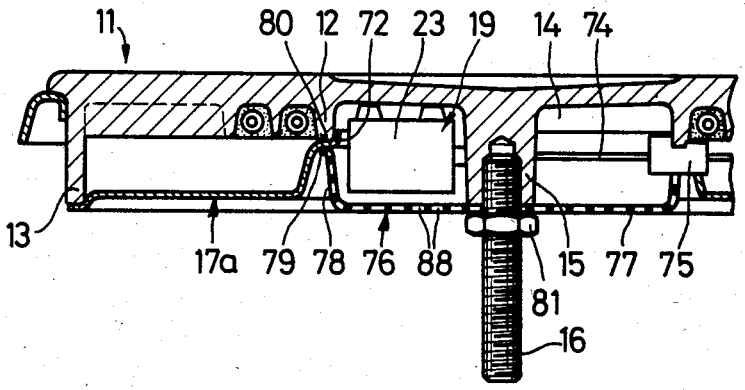
FIG. 4 is a section along line IV—IV of FIG. 3.

In FIG. 3, the heating ring area 11 is covered towards the bottom by a cover plate 17*a*, which rests on rims 12 and 13 and which is centered by a bent-round portion 72 in the interior of inner rim 12.

Thermostat 19 is connected into one of the hotplate circuits by two connecting strips 74, forming electric leads. Leads 74 are led out of the central area by means of an insulating bushing 75 facing the thermostat 19. The central area is covered by a covering part 76, which is in the form of a relatively flat cup with a substantially planar bottom 77, a substantially cylindrical surface 78 and an outwardly projecting support flange 79 at the end of the cylindrical surface 78. This support flange 79 rests on a shoulder 80 of cover plate 17*a* and presses the latter against the bottom or rim 12. The cup-shaped covering part 76 is made from perforated steel metal material with a relatively large thickness of preferably over 0.8 mm, and in the present embodiment it is 1 mm thick. In the present embodiment, the sheet metal material has circular holes 80, arranged in a random manner and whose diameter is only a few millimeters. The perforated area is preferably between one (1) and two-thirds ($\frac{2}{3}$) of the total surface area, and in a particularly preferred embodiment, is one half ($\frac{1}{2}$) of the total surface area. As a result of the manufacturing the cup from sheet metal material perforated prior to cup deformation, the holes are arranged over the entire cup surface. Nevertheless, in the vicinity of the outer support flange 79 the material forms such a relatively continuous surface, that the cup uniformly presses cover plate 17*a* against rim 12.

Covering part 76 is secured by means of a nut 81 screwed onto the clamping bolt 16, so that the cover plate 17*a* is also fixed.

Thermostat 23 is open at one side, i.e. its bimetallic strip and current-carrying switch parts are not covered by a separate insulating cover. It is virtually impossible in normal operation that anything could come into contact with these current-carrying parts, without simultaneously coming into contact with the grounding system, which is provided by the latticed or perforated covering part.

Figure 5:
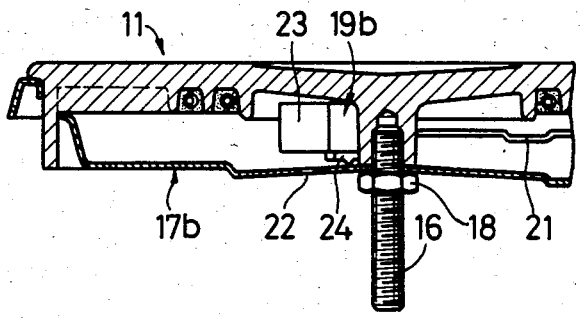
FIG. 5 is a partial section through a hotplate.

The hotplate in FIG. 5 corresponds to that of FIG. 1, apart from the differences described hereinafter.

In the vicinity of thermostat 19, cover plate 17*b* is provided with a plurality of vents. Between the casing 23 of thermostat 19 and cover plate 17*b*, there are two fixing parts 24.

Figure 6:
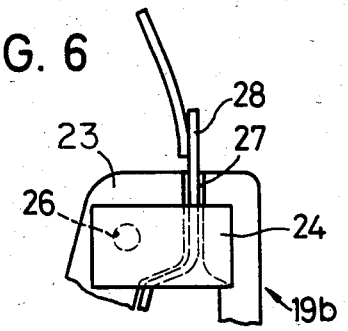
FIG. 6 is a detail of a thermostat.

FIG. 6 shows a larger-scale detail of casing 23 of a thermostat 19*b*. Its casing 23 has three holes 26 which, in the case of conventional mounting arrangements for thermostats, serve to fix a cover from above onto the casing. There is a slot 27, through which passes a connecting element 28 of thermostat 19*b* and which is enclosed by a fixing part 24. On the bottom of fixing part 24, there is a cylindrical pin, which is inserted in the dotted-line hole 26. Thus, it covers the connecting element 28 and prevents any unintentional movement of the complete switch mechanism out of the casing and supports the thermostat on the cover plate or the hotplate body. For fixing the left-hand connecting element 29 (FIG. 2) and the switch support 30, in this case a common fixing element is used, which engages with a cylindrical shoulder in hole 26 and with at least one further shoulder in the left-hand slot 27 or in recess 31 for switch support 30.

Figure 7:
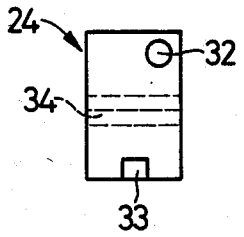
FIGS. 7 to 9 are partial perspective views of fixing parts.

FIG. 7 is a view from below of a fixing element 24, which has a circular cylindrical shoulder 32 and a parallelepipedic shoulder 33. It is placed on casing 23 of thermostat 19 in such a way that shoulder 32 engages in hole 26 and shoulder 33 in slot 27.

Figure 8:
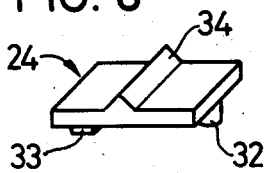
Figure 9:
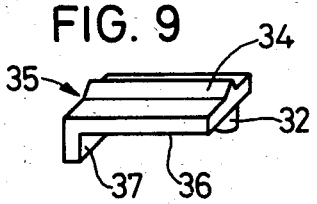

FIG. 8 shows the fixing element 24 according to FIG. 6. On the side of the fixing element opposite to shoulders 32, 33 is provided a rib 34, which provides a linear engagement of cover plate 17*b*.

Fixing element 35 according to FIG. 6 has on its bottom surface 36, an elongated shoulder 37, which is as long as the fixing element is wide, as well as a cylindrical shoulder 32 and a rib 34.

Figure 10:
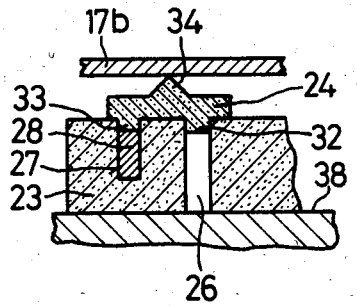
FIGS. 10 and 11 are partial sections through the thermostat casing and cover plate.

In FIG. 10, casing 23 of thermostat 19 engages flush on the bottom surface 38 of the unheated central area 14 of the hotplate. The connecting element 28 is inserted in a slot 27, which is open at one side. One shoulder 32 of fixing element 24 engages in hole 26, while its second shoulder 33 engages in slot 27 above connecting element 28 and is consequently secured against rotation. Cover plate 17*b* is arranged above fixing element 24 and is screwed onto central lug 15 in the manner stated hereinbefore. It engages on rib 34 of fixing element 24. As a result of this arrangement, in the case of a turned-round built-in state, all the switch or thermostat elements are protected against falling out, so that they do not have to be cemented in.

Figure 11:
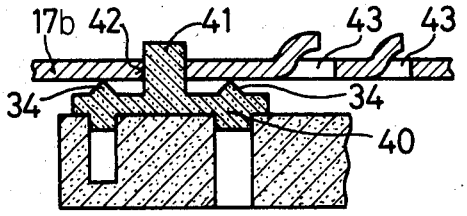

FIG. 11 shows that on its side remote from the hotplate, a further fixing element 40 has, in addition to two ribs 34, a higher shoulder 41, which engages in an opening 42 of cover plate 17. As a result of shoulder 41, it can easily be established from the outside, i.e. from above in FIG. 8, whether fixing element 40 is correctly positioned.

To the right and alongside opening 42 for shoulder 41, cover plate 17*b* has two slots 43, which have been formed by stamping out and bending away.

FIGS. 12 to 15 show a thermostat 111. It has a casing 113 made from ceramic insulating material, e.g. steatite, having the shape of an elongated, rectangularly defined box, whose one long side is open. Correspondingly, the casing has two narrow end walls 115, 117, two side walls 119, 121 and a bottom 122, which bound a recess 123, while the only remaining side is the open side 124.

In recess 123 is placed a rigid sheet metal material support 125, which extends along side wall 121 and is supported thereon with a stamped part 141. A short, strong bimetallic strip 127 is fixed parallel thereto by spot weld 128, by means of which is also fixed a movable abutment 129 constructed as a flexible sheet metal strip with a one-sided bend. By turning an adjustment screw 143, which is accessible through an opening 144 in side wall 121, it is possible to adjust the bend of the particular abutment with respect to bimetallic strip 127 and consequently the basic setting of a snap-action switch 131. The latter has a catch spring arm 133, reinforced by laterally edged parts and its center is stamped out in reed-like manner and forms a catch spring 130, which is supported in the abutment 129 under bending bias. At its free end, the catch spring arm carries a contact 134 while the other end is supported in a knife-edge bearing 135, which is located on an upward bend 137 of support 125. In order not to load the knife-edge bearing 135 by the currents to be switched, a connecting stranded wire 145 is welded to the catch spring arm 133 and to support 125.

To permit the free operation of the bimetallic strip, support 125 has a number of steps and at its one end 139 has two outer, foot-like projections, which are placed in two cavities 147, whereof one is open towards recess 123 and towards the open side 124, while the other is arranged in undercut manner by an intermediate end wall portion 149 projecting towards the recess, so that when end 139 is located in the bottom-facing cavity 147 end 139, prevents a movement of the support in the direction of open side 124. An opening 151 in the bottom area is provided only for manufacturing reasons, in order to permit the manufacture of the undercut cavity 147 in a single split mold without cores and slides.

The other end 153 of the support forms an electrical connecting lug for a connecting lead 155, which is welded to said lug.

End 153 forms a narrow extension in the vicinity of bottom 122 and projects through an opening 157, which passes through the corner between end wall 117 and bottom 122 and consequently forms an opening accessible from the end wall and the bottom, whose height (at right angles to the plane of support 125) is significantly greater than the thickness of the support (approximately 3 to 4 times).

The end of support 125 within recess 123 forms a stop face 159 which, in the fitted state, faces a protection surface 161 (cf FIG. 14), which forms a step in end wall 117. From the open side 124, the protection surface can extend up to opening 157 and namely up to a height roughly corresponding to the center of opening 157.

An opposite contact 163, placed on an opposite contact support 164, faces contact 134 of snap-action switch 131. Support 164 is inserted in a slot 163, which has the flat V-shaped configuration shown in FIG. 13 and consequently relatively reliably fixes in clearance-free manner, the correspondingly dimensioned opposite contact support 164 during its insertion. The final securing action is provided by welding a connecting lead 166 to the portion of the opposite contact support 164 projecting outwards over bottom 122.

During manufacture, the complete functional unit consisting of support 125, bimetallic strip 127 and snap-action switch 131 are completely preassembled. The short, strong bimetallic strip 127, which tapers somewhat to a free end, is welded to the support, together with the abutment 129, the catch spring arm 133 and catch spring 130 are hung in and the stranded wire 145 is welded. Opposite contact support 164 is inserted in slot 165 and then the aforementioned preassembled unit is introduced into recess 123. Initially, end 153 is slopingly placed through opening 157 in such a way that the stop face 159 of support 125 (cf FIG. 12 or 14) is above the protection surface 161. Thus, support 125 can be moved so far to the left that end 139 can be swung inwardly in the direction of the curved arrow 167 in FIG. 13 and end 139 can still be freely moved from the projecting end wall portion 149. When support 125 has been introduced into its position engaging on bottom 122, it is only necessary to form support 125 to the right and, as a result of its own bias, catch spring arm 133 presses support 125 downwards in FIGS. 12 and 14, so that stop face 159 faces protection surface 161 and now no longer permits a leftward displacement of support 125, so that the snap-action switch support is secured in the position shown in FIGS. 12 and 14. The final securing action is brought about in that on welding connecting lead 155, the latter is forced into the part of opening 157 remaining above end 153, for which purpose the lead can be slightly bent.

Figure 13:
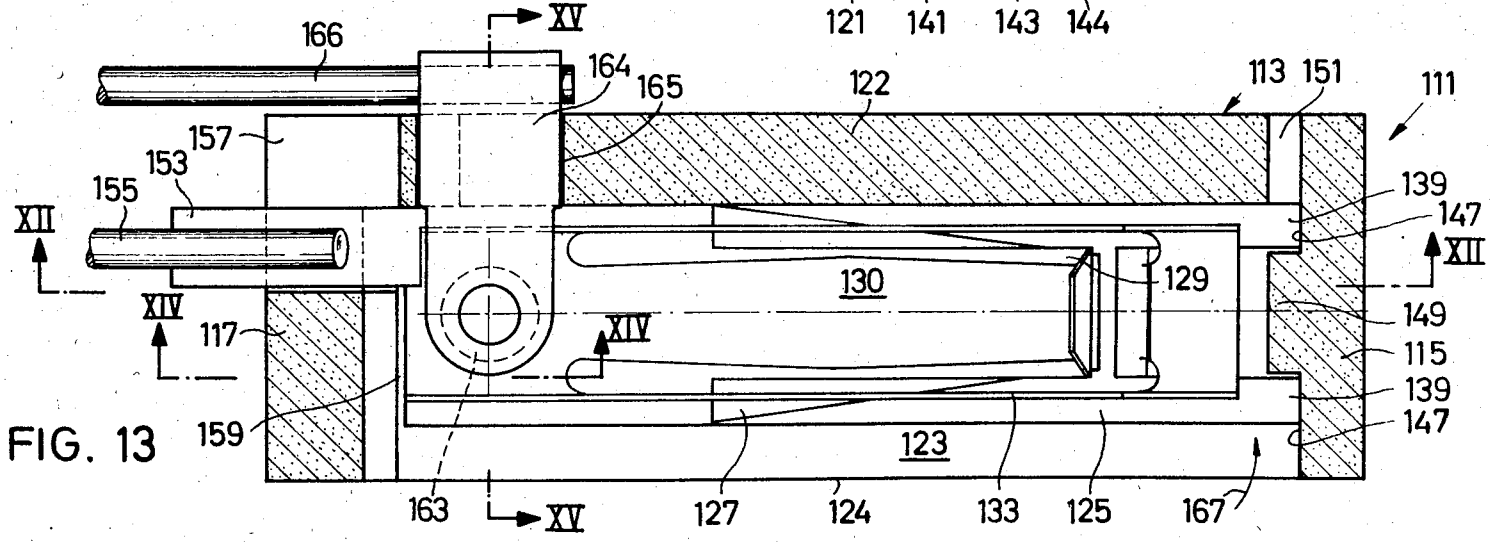
FIG. 13 is a section along the bent section line XIII—XIII in FIG. 12.
Figure 14:
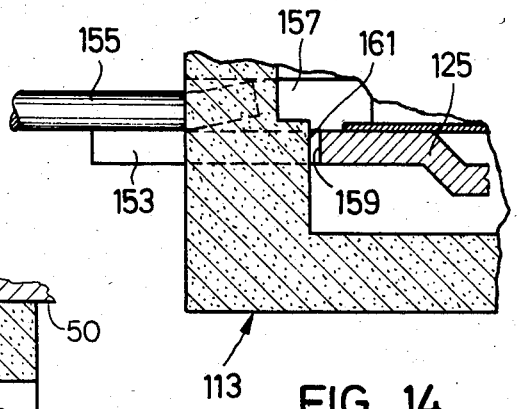
FIG. 14 is a detailed section along line XIV—XIV in FIG. 13.
Figure 15:
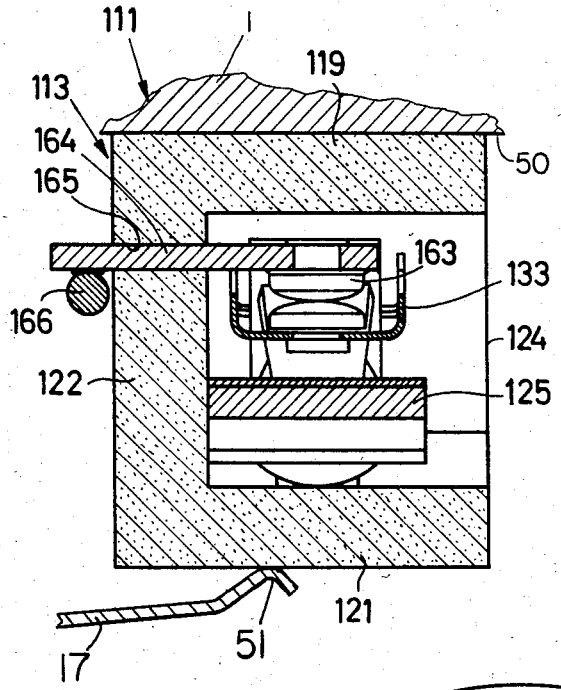
FIG. 15 is a cross-section along line XV—XV in FIG. 13.

FIGS. 13 and 15 show that fixing has taken place in such a way that the current-carrying or live unit formed by support 125, bimetallic strip 127 and snap-action switch 131 is a considerable distance from open side 124, i.e. the end and side walls 115 to 121 project between 1 and 3 mm beyond said parts. In view of the relatively limited width of the recess (less than 10 mm), this provides an adequate protection against contact, so that there is no need for a cover projecting over recess 123. This improves the thermal coupling of the thermostat and further reduces its already limited overall weight, which is advantageous from the switching and leakage current behaviour standpoint.

Figure 12:
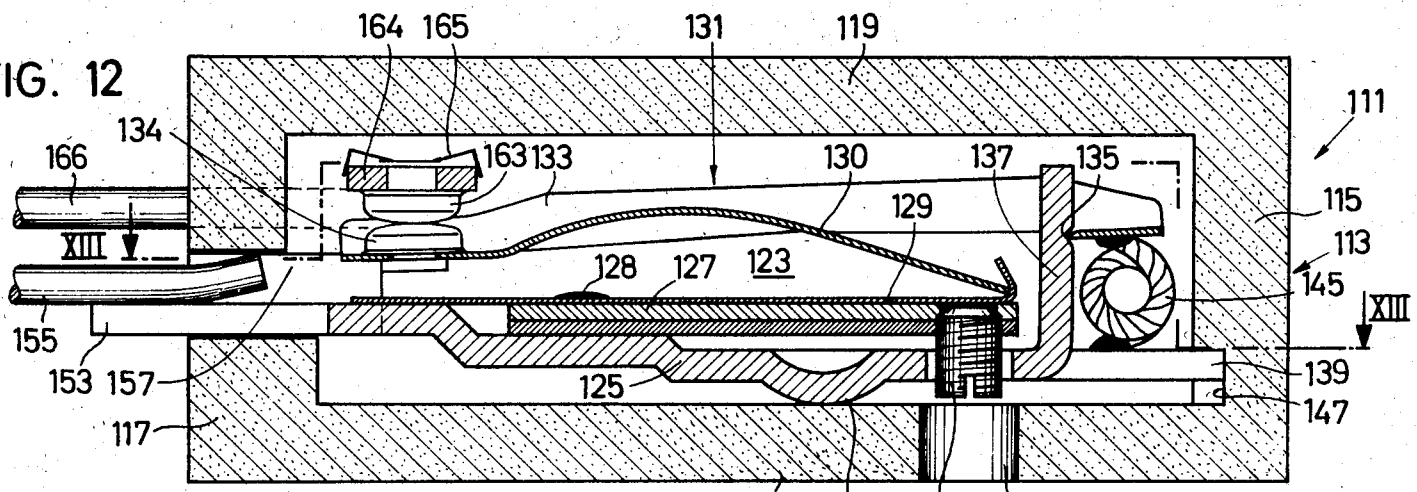
FIG. 12 is a longitudinal sectional through a thermostat along line XII—XII in FIG. 13.

The snap-action switch adjusted by raising the movable abutment 129 with respect to bimetallic strip 127 is operated if, as a result of heating, bimetallic strip 127 has bent so far upwards in FIG. 12 that the snapping point of the switch is reached. Contacts 134, 163, which are shown closed, are then opened.

Figure 16:
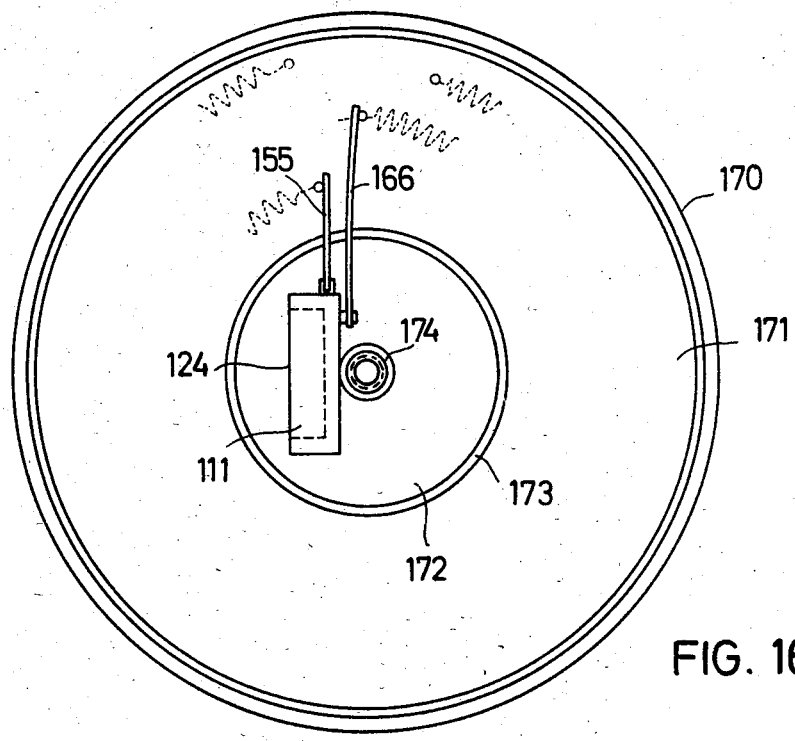
FIG. 16 is a view from below of a hotplate equipped with a thermostat.

FIG. 16 shows the thermostat 111 in its arrangement on a hotplate 170. The latter is a cast plate with a heated ring area 171, where thermostat 111 is arranged in the unheated central area 172 surrounded by a rim 173. It is placed on one side of a cast-on fixing connection 174 with its open side 124 towards rim 173 and consequently pointing towards the heating system. The connecting leads 155, 166 pass directly to corresponding terminal pins, which project from the ceramic embedding material in the heated ring area and lead to one or more heating resistors in the heated ring area.

In the position represented in FIG. 16, the interior of the thermostat is freely accessible to the heat coming from the hotplate, both by radiation and by conduction and convection. By changing the position, in such a way that e.g. the open side 124 faces fixing connection 174, these couplings can be modified. Normally, the thermostat is fitted between the underside 50 of the central zone of the hot plate body 1 and projections 51 of cover 17 as shown in FIG. 1, in such a position that side 121 engages on the hotplate body, so that the bimetallic strip is nearer thereto. The coupling characteristics are also changed by turning the thermostat around to effect engagement of side 119, as shown in FIG. 15.

The thermostat is particularly easily manufactured. Its casing comprises a single ceramic piece, which can be produced in a single split mold. Only two parts need be fitted into the casing, which can both be fixed by insertion, without any need of cementing or the like. These parts are the opposite contact support and the preassembled unit formed by the support, bimetallic strip and snap-action switch. The single adjustment screw is readily accessible. The individual parts are fixed by the welding of the connecting lead, which is necessary in any case. The thermostat can still be used in many different ways and its coupling (fast or slow acting) can be adapted to different requirements by merely turning round at the time of fitting. It has been found that there is no need with this thermostat to cover the central area 172 of the hotplate with a separate cover, as has been hitherto necessary, while there is no increased risks of leakage currents.

It is also advantageous that the two connections 153, 164 are located in the vicinity of a narrow side of the casing, so that the connecting leads leading therefrom are short and can pass in juxtaposed manner through a recess in the rim 173.

We claim:

1. An electric hotplate comprising:

a hotplate body including a heated zone having heating resistors and electric circuitry for connecting the resistors to a source of electrical energy, said circuitry including a thermostat having:

a casing formed in one piece from an insulating material with a bottom and four side walls defining one open-sided recess therebetween; and, a snap-action switch, a support and a bi-metallic strip mounted on the support and acting on the switch, the casing having slots formed therein for fixing the switch, support and strip in the recess, the improvement comprising:

the recess remaining open at the one side when the casing is mounted on the hotplate body and in contact therewith; and the support and the slots having locking means for preventing movement of the support out of the recess, the locking means including interfitting locking structure on the support and formed interiorly on at least one of the side walls, which structure can be brought to mutual engagement by movement of the support substantially parallel to the bottom of the casing.

2. An electric hotplate with a thermostat according to claim 1, wherein the hotplate has a substantially unheated central zone, and the thermostat is adapted for mounting with one side wall facing the underside of the central zone and the open side of the thermostat casing facing horizontally toward a directly heated portion of the hotplate.

3. An electric hotplate with a thermostat according to claim 2, wherein the casing is adapted to be supported on a cover plate for the bottom of the electric hotplate, the casing being pressed into clearly defined contact with the underside of the hotplate in the unheated central zone.

4. An electric hotplate with a thermostat according to claim 3, wherein the casing is adapted for pressing against a flattened portion of the underside of the hotplate.

5. An electric hotplate with a thermostat according to claim 3, wherein the casing is adapted for pressing by inwardly directed, resilient projections on the cover plate.

6. Electric hotplate according to claim 1, characterized in that the functional parts of the thermostat are arranged in an open, cover-less recess of the casing, whose opening faces the hotplate body.

7. Electric hotplate according to claim 5, characterized in that projections are provided on the casing side containing the recess opening and are pressed into contact with the hotplate body surface.

8. Electric hotplate according to claim 7, characterized in that the preferably free projections are shaped onto the casing edge surrounding the recess and in particular have a rounded and optionally a conical configuration.

9. Electric hotplate according to claim 1, characterized in that a cover plate covering the bottom of the electric hotplate leaves the central area free and in the vicinity of the central area is provided a separate, perforated covering part, which is fixed by a central bolt engaging in the central area of the hotplate and which projects through the central portion of the covering part and is a cup made from perforated sheet metal material.

10. Electric hotplate according to claim 9, characterized in that the cup-shaped covering part is made from a sheet metal material, perforated prior to deformation and which has a relatively great thickness (preferably more than 0.8 mm), the diameter of the holes only being a few mm, whereby the perforated surface preferably represents between one and two thirds, and particularly preferably half of the total surface area.

11. Electric hotplate according to claim 9, characterized in that the perforations are also provided in the substantially cylindrical surface area of the covering part.

12. Electric hotplate according to claim 9, characterized in that substantially over its entire circumference, the edge or rim of the covering part rests on a shoulder of the annular cover plate and presses the latter against a hotplate body rim surrounding the central area.

13. Electric hotplate according to claim 12, characterized in that the edge of the covering part has an all-round, outwardly projecting support flange.

14. Electric hotplate according to claim 1, characterized in that the thermostat casing is open on its side remote from the hotplate and the switch parts inserted in the slots are protected against falling out by at least one fixing part at least partly covering these slots and insertable in recesses of the thermostat casing, said fixing part directly engaging on the cover plate covering the bottom of the hotplate.

15. Electric hotplate according to claim 14, characterized in that the fixing part has at least one cylindrical shoulder for engaging in a hole provided in the thermostat casing and at least one cylindrical shoulder for engaging in a slot.

16. Electric hotplate according to claim 14, characterized in that the fixing part has on its side facing the cover plate at least one engagement lug, engagement rib, etc.

17. Electric hotplate according to claim 14, characterized in that in the vicinity of the thermostat, the cover plate has openings, holes, slots, etc.

18. Electric hotplate according to claim 14, characterized in that on its side remote from the hotplate, the fixing part has a shoulder extending through a corresponding opening in the cover plate.

19. An electric hotplate with a thermostat according to claim 1, wherein the side walls of the casing surrounding the recess project beyond the snap-action switch and the bimetallic strip by a distance in the range of 1 to 3 mm.

20. An electric hotplate with a thermostat according to claim 1, wherein the engaging structure comprises the at least one side wall having at least one inwardly opening cavity, in which one end of the support is secured against movement in a direction toward the open side of the casing recess, and in the vicinity of the opposite end of the support, a side wall has an opening in which the opposite end of the support is secured against movement toward the open side of the recess, but can move to a limited extent in a direction at right angles thereto to enable the parallel movement; and, a stop face on the support which cooperates with a protection surface provided on the side wall having the opening therethrough, the distance between the support end engaging in the cavity and the stop face being greater than the distance from the side wall having the cavity to the protection surface, but smaller than the distance from the side wall having the cavity to the side wall on which the protection surface is formed.

21. An electric hotplate with a thermostat according to claim 20, wherein pressure exerted by the snap-action switch against a counter-contact forces the support into mutual engagement with the protection surface.

22. An electric hotplate with a thermostat according to claims 20 or 21, wherein the casing comprises a support portion projecting through the opening and forming a connecting lug, an electrical connecting lead being insertable between a wall of the opening and the support portion.

23. An electric hotplate with a thermostat according to claim 1, further comprising a counter-contact, cooperating with the snap-action switch, inserted into a cross-sectionally arcuate slot in the casing and secured in position by having a connecting lead welded thereto.

24. An electric hotplate with a thermostat according to claim 1, wherein all electrical connections for the thermostat are arranged in the vicinity of a narrow side wall of the casing.

25. An electric hotplate with a thermostat according to claim 1, further comprising a counter-contact cooperating with the snap-action switch, inserted into a cross-sectionally flat V-shaped slot in the casing and secured in position by having a connecting lead welded thereto.

* * * * *